United States Patent [19]

Palmaer

[11] 4,069,512

[45] Jan. 24, 1978

[54] LOCATING DEVICE FOR EAR-MUFFS ON HELMETS

[76] Inventor: Tore Georg Palmaer, Smultronvagen 28, S-331 00, Varnamo, Sweden

[21] Appl. No.: 576,898

[22] Filed: May 12, 1975

[51] Int. Cl.[2] ..... A42B 1/06

[52] U.S. Cl. ..... 2/209; 2/423

[58] Field of Search ..... 2/209, 3 R, 423; 179/156 R

[56] References Cited

U.S. PATENT DOCUMENTS

| | | | |
|---|---|---|---|
| 958,263 | 5/1910 | Loewe | 2/209 X |
| 3,461,463 | 8/1969 | Beguin | 2/209 X |
| 3,845,505 | 11/1974 | Davison | 2/209 |
| 3,898,700 | 8/1975 | Davison et al. | 2/209 |

*Primary Examiner*—Werner H. Schroeder
*Assistant Examiner*—Peter Nerbun

[57] ABSTRACT

The present invention relates generally to a device for locating ear-muffs arranged on a helmet or the like by means of bearing members arranged in the helmet to pivotally receive attachment members, each of said members cooperating with an ear-muff cover by a clamp-shaped arm. The attachment members being with their upper ends of said arms located inside the helmet and displaceable arranged in a longitudinal direction. In this way any desired location of said ear-muffs — parking position within the helmet or working position covering the ears — could easily be established.

7 Claims, 7 Drawing Figures

Fig.3
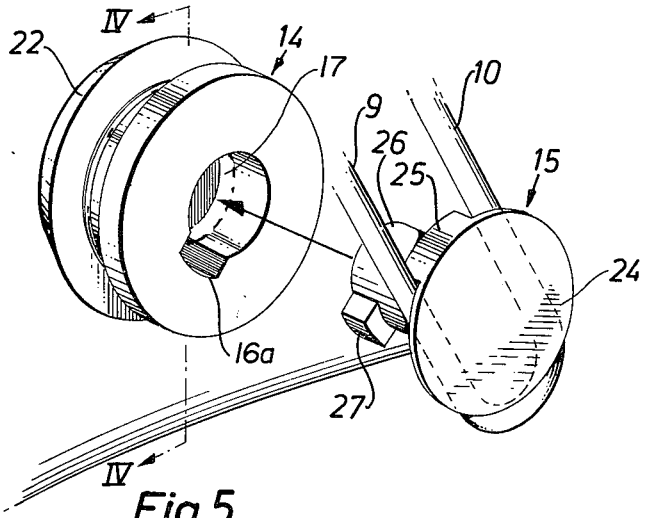
Fig.4
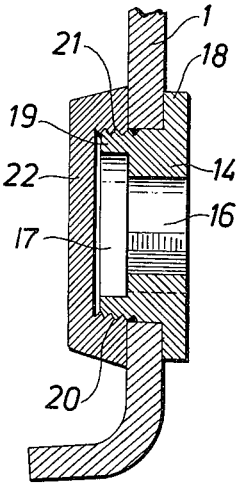
Fig.5
Fig.6
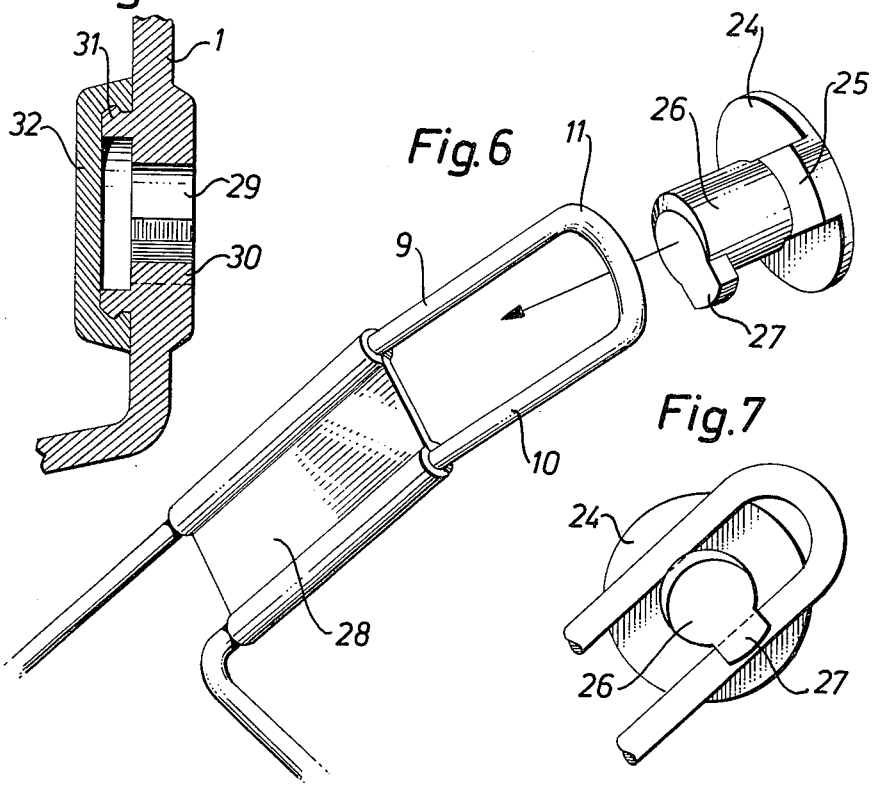
Fig.7

LOCATING DEVICE FOR EAR-MUFFS ON HELMETS

BACKGROUND OF THE INVENTION

The present invention relates to a locating device for ear-muffs or the like in a protective helmet or other suitable headgear of solid material.

When using conventional protective equipment consisting of a helmet provided with muffs to protect the hearing organs, it is often necessary to temporarily remove the protective covers from the ears while still using the helmet, i.e. the acoustic surroundings may change, whereas the protection afforded by the helmet should be maintained. This has been impossible to achieve in a reliable manner with the known arrangements, which in turn has resulted in the protective covers not being used in certain situations.

Accordingly, the invention has for its primary object the provosion of a new and improved hat or helmet having a locating device mounted thereon to enable any desired displacement of such ear-muffs so that the covers can be moved by simple manual intervention from their position when in use to a temporary parking position.

Another object of the invention is to provide a new and improved locating device permitting the ear covers to be easily dismentled from the helmet and also permitting an easy adjustment of said covers to enable exact positioning of the covers during their use.

SUMMARY OF THE INVENTION

In accordance with the present invention the foregoing and other objects are accomplished by providing bearing members in the helmet shell, said bearing members being arranged to pivotably and detachably receive attachment members carrying the ear-muff covers.

In one form of the invention bearing member consist of a holder insertable in a corresponding recess in the helmet shell or else the bearing member may be constructed in the helmet shell itself.

In a second form of the invention, the attachment member is provided with a bearing pin which can be removed from or pivotably attached in the bearing member, as well as members into which the shafts of the ear-muff covers can be slipped or withdrawn therefrom.

In a third form of the invention the ear-muff covers are suitably arranged in a wire shackle, the shafts of which above the covers continue into a backwardly curved section in which the two shafts approach each other and run substantially parallel with each other to form a loop and that said section is arranged to be removable from or can be fitted into the attachment member by sliding.

An attachment member constructed in this manner thus gives the advantage that each cover can be temporarily moved by a simple manual operation to a parking position i.e. away from the ear, as well as the opportunity of adjusting the position of the covers in the attachment piece. Furthermore, the ear-muff shackles can easily be detached from the helmet and the means may be attached either on the inside or the outside of the helmet.

The invention both as to its organization and manner of operation together with further objects and advantages will best be understood by reference to the following detailed description taken in conjunction with the accompanying drawings wherein FIG. 1 is a side elevational view illustrating a helmet manufactured in accordance with the invention FIG. 2 is a rear view of the helmet shown in FIG. 1

FIG. 3 shows a detail of the actual attachment means for the ear-muff

FIG. 4 is a section through the attachment means shown in FIG. 3 and

FIGS. 5 - 7 show details of another embodiment of the attachment means.

Figure 1:
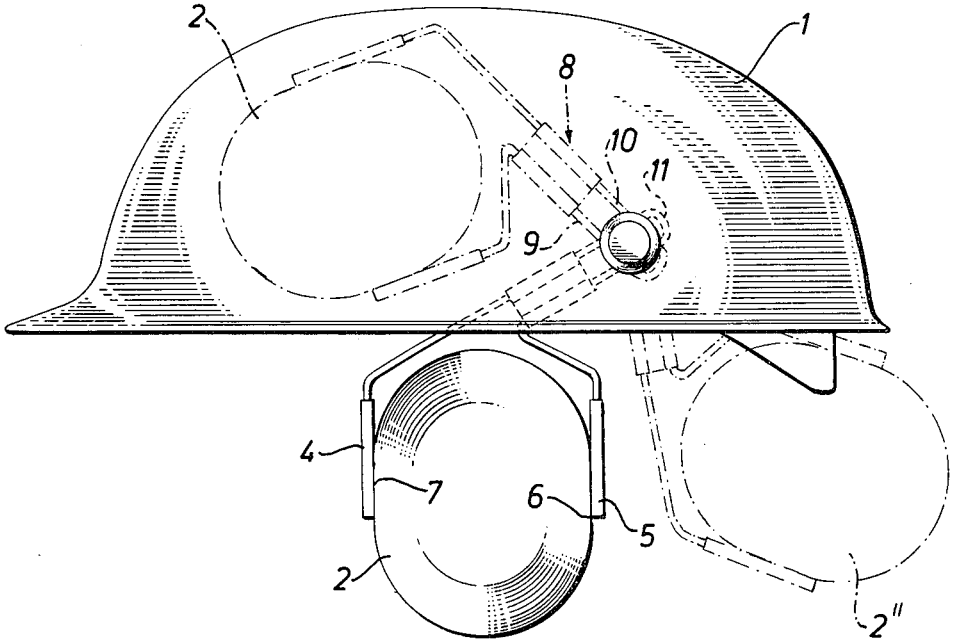
Figure 2:
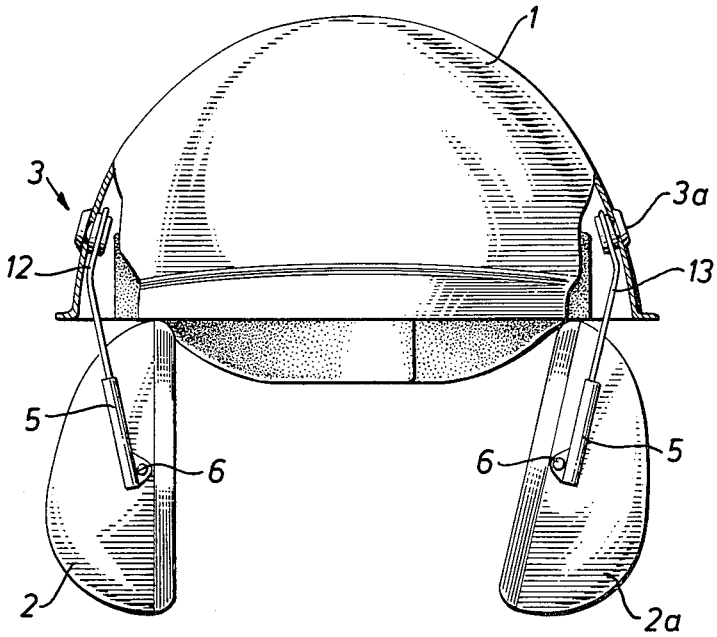

Referring now to the drawings the present invention is there illustrated as comprising a helmet 1. In the helmet 1 two ear-muff covers 2, **2*a* are pivotably journelled about attachment means 3, 3*a*, the latter preferably being placed slightly behind the projected centre line of the ear so that the ear-muff cover 2, 2*a* is below the brim of the helmet when swung away from the ear. FIG. 1 shows how the cover 2 can be swung about the attachment means 3 either to a position 2' inside the helmet 1 as indicated in broken lines or to a position 2'' outside the helmet and away from the ear, also indicated in broken lines. As will be further described the cover may, for example, be lifted out of the attachment means when turned to position 2'' and when turned forwards to position 2'** inside the helmet it is conveniently placed for when the helmet is being carried.

Each cover 2, **2*a* is supported by a wire shackle, the ends 4, 5 thereof gripping the cover 2 between them. The cover 2 is pivotably journalled in bearing points 6, 7 in the ends 4, 5, respectively. Above the cover 2 the wire shackle continues into a backwardly curved section 8 in which the two wire shanks 9, 10 approach each other and run substantially parallel with each other, finally meeting to form a loop 11. In the vicinity of the loop 11 the wire shackle is bent slightly inwards to fit the shape of the helmet (note the bend to the right 12 on the cover 2 and the bend to the left 13 on the cover 2*a***).

As is particularly clear from FIGS. 3–7, the attachment means comprises bearing members 14 for the attachment members 15. The bearing member 14 may either consist of a holder inserted in a corresponding recess in the helmet 1 (FIGS. 3 and 4) or may be formed directly in the helmet shell (FIG. 5). In the embodiment according to FIGS. 3 and 4 the bearing member 14 is in the form of a holder arranged in a recess in the helmet shell 1, the bearing member 14 having a central opening 16 in which is formed an axial slot **16*a* and an undercut circumferential groove 17 and a peripheral flange 18 intended to abut against the inner side of the helmet shell 1 and a flange 19 protruding from the recess, said flange 19 being provided with a thread 20 on its outer side, intended to cooperate with the internal threading 21 of an outer cap 22 which, when the holder 14 is fitted, is designed to position and lock the holder while at the same time serving as protective covering. A gap is therefore formed between the holder 14 and the protective covering 22**.

One end of the attachment member 15 is constructed in the form of a substantially circular end plate 24 with a raised section 25 running centrally across it. A central bearing pin 26 projects from the raised section, the diameter of the pin slightly exceeding the width of the raised section. The raised section projects so far from the end plate 24 that the shanks 9, 10 of the wire shankle can be movably held between the end plate 24 and the parts of the pin 26 protruding outside the raised section 25. At the opposite end of the pin 26 is a guiding boss 27 corresponding to the groove 17 in the holder.

As can be seen from FIG. 6, the shanks 9, 10 of the wire shackle in the area of the loop 11 are brought towards each other by displacing a stabilizing member 28 movably attached between the shanks 9, 10.

The arrangement of the wire shanks 9, 10 on the attachment member 15 as proposed according to the invention thus enables arbitrary longitudinal displacement of the wire shackle in relation to the pin 26, thus enabling extremely accurate, but still simple, adjustment of the position of the covers 2, 2a.

FIG. 5 shows an alternative embodiment of the attachment means in which the bearing member 14 for the attachment member 15 are constructed directly in the shell of the helmet. The helmet shell 1 has in this case been provided with a recess 29 corresponding to the pin 26 and having a slot 30 corresponding to the guiding boss 27. An annular flange 31 protrudes from the outside of the helmet to receive a snap-on lid 32 or the like.

The invention is of course not limited to the embodiments shown in the drawings but can be varied in many ways within the scope of the following claims. Thus the locating means described may also be used for other accessories for helmets such as hearing or speech equipment. Since the ear-muff covers are attached in a shackle part having a backwardly directed section which in turn is slidably attached in the attachment member itself, the backwardly directed section can be moved in the attachment member to give a correct fit with the lining of the helmet.

What is claimed is:

1. An ear cover and helmet combination including means for adjustably attaching said ear cover to the interior of a helmet comprising a shackle attached to said cover and having an extending shank formed by a pair of parallel spaced arms interconnected by an integral loop at their ends, a bearing formed in the side of said helmet, a rotatable pin removably journalled within said bearing and extending into the interior of said helmet between the arms of said shank, the bearing having an axial slot and an undercut circumferential groove within the bearing, the extending portion of the pin having a radial boss movable through said axial slot and adapted to engage the interior frontal edge of said undercut circumferential groove of the bearing to prevent axial displacement of said pin, a pair of lands formed chordally on a member extending from said rotatable pin, said pair of lands cooperating with said shank to secure said shackle for conjoint rotation therewith and for longitudinal displacement thereon, permitting said shackle and said cover being selectively movable into and out of the interior of said helmet while being worn and permitting said pin and shackle to be removed from said helmet.

2. The apparatus according to claim 1 wherein said shank is curved to conform to the shape of said helmet and said bearing is located to the rear of the center line of said helmet, to permit said covers to move into and out of said helmet.

3. The apparatus according to claim 1 including means for stabilizing the arms of said shank, said stabilizing means comprising a member joining said arms between said loop and said cover and being movable along the shank.

4. The apparatus according to claim 1, wherein said rotatable pin is provided with a circular end plate and said means for securing said pin comprises a raised section extending diametrically across said plate, said bearing pin projecting axially from said raised section and having a diameter somewhat greater than the width of said raised section.

5. The apparatus according to claim 1, wherein a protective cap is arranged to cover the bearing on the outside of the helmet.

6. The apparatus according to claim 5, wherein said protective cap consists of a snap-on lid.

7. The apparatus according to claim 5, wherein said protective cap is arranged to be screwed on to a flange of the holder protruding from the helmet shell.

* * * * *